US007311080B2

(12) United States Patent
Mine

(10) Patent No.: US 7,311,080 B2
(45) Date of Patent: Dec. 25, 2007

(54) IDLE SPEED CONTROLLER OF INTERNAL, COMBUSTION ENGINE, AND INTERNAL COMBUSTION ENGINE CONTROLLER AND INTERNAL COMBUSTION ENGINE

(75) Inventor: Yasutaka Mine, Shizuoka (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 10/551,246

(22) PCT Filed: Mar. 29, 2004

(86) PCT No.: PCT/JP2004/004429

§ 371 (c)(1),
(2), (4) Date: Jun. 29, 2006

(87) PCT Pub. No.: WO2004/088111

PCT Pub. Date: Oct. 14, 2004

(65) Prior Publication Data

US 2006/0243245 A1 Nov. 2, 2006

(30) Foreign Application Priority Data

Mar. 28, 2003 (JP) ..... 2003-092447

(51) Int. Cl.
*F02D 41/08* (2006.01)

(52) U.S. Cl. ..... 123/339.14; 123/435

(58) Field of Classification Search ..... 123/339.14, 123/339.21, 339.23, 435, 494; 73/118.2
See application file for complete search history.

(56) References Cited

U.S. PATENT DOCUMENTS 4,491,107 A * 1/1985 Hasegawa et al. ..... 123/327
4,508,074 A * 4/1985 Yamato et al. ..... 123/327
4,570,592 A * 2/1986 Otobe ..... 123/339.23
4,633,093 A * 12/1986 Otobe et al. ..... 290/40 R
4,725,954 A * 2/1988 Takao et al. ..... 701/110
4,858,136 A * 8/1989 Tanaka et al. ..... 701/110
4,903,660 A * 2/1990 Sogawa ..... 123/339.14
4,907,556 A * 3/1990 Ishii et al. ..... 123/486
5,564,387 A * 10/1996 Igarashi et al. ..... 123/339.23
6,152,105 A * 11/2000 Nishimura et al. .... 123/339.11
6,212,879 B1 * 4/2001 Nishimura et al. ..... 60/274
6,367,446 B1 * 4/2002 Kanamaru et al. ..... 123/339.12
6,394,069 B1 * 5/2002 Kondo ..... 123/339.19

(Continued)

FOREIGN PATENT DOCUMENTS

JP 06-146961 5/1994

(Continued)

*Primary Examiner*—Hai Huynh
(74) *Attorney, Agent, or Firm*—Hogan & Hartson LLP

(57) ABSTRACT

An idle rotational speed controller of an internal combustion engine includes an intake path for supplying air to a combustion chamber. An auxiliary intake path communicates the intake path on upstream and downstream sides of a throttle valve in the intake path. An opening/closing type control valve in the auxiliary intake path controls an idling intake amount. An intake pressure detecting unit detects an intake pressure of the intake path, and a fuel supplying unit controls the amount of fuel supplied to the combustion chamber based on the detected intake pressure. A controlling unit synchronizes a drive reference position for driving to open or close the control valve with a timing of detecting the intake pressure by the intake pressure detecting unit.

16 Claims, 13 Drawing Sheets

U.S. PATENT DOCUMENTS 6,491,032 B1 * 12/2002 Kanno ..... 123/680
6,932,057 B2 * 8/2005 Sawada et al. ..... 123/406.47

FOREIGN PATENT DOCUMENTS

JP 08-158920 6/1996
JP 2000-110619 4/2000
JP 2002-122040 * 4/2002
JP 2003-065141 3/2003
JP 2006-9632 * 1/2006

* cited by examiner

IDLE SPEED CONTROLLER OF INTERNAL, COMBUSTION ENGINE, AND INTERNAL COMBUSTION ENGINE CONTROLLER AND INTERNAL COMBUSTION ENGINE

TECHNICAL FIELD

The present invention relates to an idle rotational speed controller, a controller of an internal combustion engine and an internal combustion engine, which enable stable idling operation.

BACKGROUND ART

For example, there is an internal combustion engine mounted to a vehicle including an auxiliary intake path opened to a downstream side of a throttle valve of an intake path and communicating with the atmosphere, a control valve for controlling an auxiliary air amount (idling intake amount) supplied to the internal combustion engine via the auxiliary intake path, and a fuel supplying unit for supplying a predetermined fuel amount in accordance with a total intake amount including the auxiliary air amount to a combustion chamber of the internal combustion engine, in which a predetermined rotational position of the internal combustion engine is detected and the control valve is opened in synchronism with a signal of the predetermined position (refer to, for example, Patent Reference 1).

(Patent Reference 1) JP-B-63-60219 (pages 1-7, FIGS. 1-4)

According to a controller of an internal combustion engine for controlling a fuel supply amount of the fuel supplying unit by detecting an intake pressure of the intake path by an intake pressure detecting unit arranged on the downstream side of the throttle valve of the intake path, when the auxiliary intake path is connected to the downstream side of the throttle valve of the intake path and the control valve of an opening/closing type is used, there is a case in which by a change in the intake pressure by operating to open and close the control valve, despite a steady state, the state is erroneously determined to shift to an accelerating or decelerating state and an idling rotational speed becomes unstable.

In addition, when a threshold of the change in the intake pressure for determining that the state is shifted to the accelerating or decelerating state in order to avoid the case, drivability in opening the throttle valve intended by a driver is deteriorated.

Further, according to a system which is not provided with a stroke determining sensor for determining a stroke of the internal combustion engine by detecting the intake pressure of the intake path, when a condition of a number of times of establishing stroke determination is increased in order to avoid that the stroke of the internal combustion engine cannot be determined based on a similar cause, starting performance of the internal combustion engine is deteriorated.

When a ratio of a time period of opening the control valve within a predetermined time period is controlled (duty control), in consideration of a fluctuation in rotation of the internal combustion engine, the control to open and close the control valve becomes complicated and a calculating load is increased.

When a user changes to set the idling rotational speed to be low, a fluctuation in rotation of the engine is increased and there is a case that the idling rotational speed cannot be controlled stably.

The invention has been carried out in view of such a situation and it is an object thereof to provide an idle rotational speed controller, a controller of an internal combustion engine and an internal combustion engine, which enable stable idling operation.

DISCLOSURE OF THE INVENTION

In order to solve the above-described problem and achieve the object, the invention is constituted as follows.

A first aspect of the invention is an idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller including: an intake pressure detecting unit for detecting an intake pressure of the intake path; a fuel supplying unit for controlling a supply amount of a fuel supplied to the combustion chamber based on at least the intake pressure; and a controlling unit for synchronizing a drive reference position for driving to open or close the control valve with a timing of detecting the intake pressure by the intake pressure detecting unit.

Incidentally, the controlling unit determines the fuel supply amount of the fuel supplying unit by predicting a steady state load from the intake pressure, for example, the intake pressure at a predetermined position of a crank angle of the internal combustion engine. Further, the fuel supply amount determined by the controlling unit is the fuel supply amount of a successive cycle.

According to the first aspect of the invention, by synchronizing the drive reference position of driving to open and close the control valve with the timing for detecting the intake pressure by the intake pressure detecting unit, it can be prevented that the intake pressure detecting unit erroneously detects a pressure fluctuation caused by operating to open and close the control valve and the supply amount of the fuel cannot stably be controlled, and stable idling rotation can be carried out.

A second aspect of the invention is characterized in that the controlling unit controls a state of closing the control valve by setting a timing of driving to close the control valve as the drive reference position in the idle rotational speed controller of an internal combustion described in the first aspect.

According to the second aspect of the invention, in addition to the effect of the first aspect, when an idling rotational speed is increased, the control valve is controlled in a direction of restraining an engine rotational speed, and when the idling rotational speed is reduced, the control valve is controlled in a direction of increasing the engine rotational speed, and therefore, the fluctuation in rotation of the internal combustion engine can be restrained.

A third aspect of the invention is characterized in that the controlling unit increases the supply amount of the fuel when a pressure difference between the intake pressure before one cycle or more and a current one is equal to or larger than a threshold in accordance with a state of opening or closing the control valve in the idle rotational speed controller of an internal combustion engine described in the first aspect.

Incidentally, the controlling unit detects an accelerating state by comparing, for example, the intake pressure before one cycle or more and the current intake pressure. Further, a state of opening or closing the control valve can be predicted or detected by, for example, an engine rotational speed, a throttle opening degree, a ratio (duty) of a time period of opening the control valve in a predetermined time period or the like.

According to the third aspect of the invention, in addition to the effect of the first aspect, it can be prevented that even when the state is a steady state, the state is erroneously determined to shift to the accelerating state by a change in the intake pressure caused by operating to open or close the control valve and the supply amount of the fuel is increased, and the fuel can stably be supplied.

A fourth aspect of the invention is characterized in that the threshold is set by a two-dimensional table constituting an axis thereof by an engine rotational speed in the idle rotational speed controller of an internal combustion engine described in the third aspect.

According to the fourth aspect of the invention, in addition to an effect of the third aspect, the threshold is set by the two-dimensional table constituting the axis thereof by the engine rotational speed, and therefore, the fuel can stably be supplied even at a low idling rotational speed at which the fluctuation in the intake pressure caused by operating to open or close the control valve is large.

Further, even when a user changes to set the idling rotational speed to be low, the idling rotational speed can stably be controlled without being erroneously determined that the state is not the steady state.

A fifth aspect of the invention is characterized in that the controlling unit increases the supply amount of the fuel by asynchronous injection in the idle rotational speed controller of an internal combustion engine described in the third aspect.

According to the fifth aspect of the invention, in addition to the effect of claim 3, the fuel supply amount is increased by the asynchronous injection, and therefore, the fuel can be supplied swiftly and stably.

A sixth aspect of the invention is an idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller including: an intake pressure detecting unit for detecting an intake pressure of the intake path; a stroke determining unit for determining a stroke of the internal combustion engine based on at least the intake pressure; and a controlling unit for synchronizing a drive reference position for driving to open or close the control valve with a timing of detecting the intake pressure by the intake pressure detecting unit.

Incidentally, the controlling unit determines the stroke of the internal combustion engine by, for example, a pressure difference of the intake pressure at a predetermined crank angle and a change in a speed of rotating a crank.

According to the sixth aspect of the invention, by synchronizing the drive reference position of driving to open or close the control valve with the timing of detecting the intake pressure by the intake pressure detecting unit, it can be prevented that the intake pressure detecting unit erroneously detects the fluctuation in the pressure caused by operating to open and close the control valve and the stroke cannot be determined, and stable idling rotation can be carried out.

A seventh aspect of the invention is characterized in that the controlling unit controls a state of closing the control valve by setting a timing of driving to close the control valve as the drive reference position According to the seventh aspect of the invention, in addition to an effect of the sixth aspect, when the idling rotational speed is increased, the control valve is controlled in a direction of restraining the engine rotational speed, and when the idling rotational speed is reduced, the control valve is controlled in a direction of increasing the engine rotational speed, and therefore, the fluctuation in rotation of the internal combustion engine can be restrained.

An eighth aspect of the invention is an idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller including: an intake pressure detecting unit for detecting an intake pressure of the intake path; a stroke determining unit for determining a stroke of the internal combustion engine based on at least the intake pressure; and a controlling unit for controlling the control valve by synchronizing a drive reference position for driving to open or close the control valve with a timing of detecting the intake pressure by the intake pressure detecting unit, and changing the drive reference position with respect to a crank rotation of the internal combustion engine after finishing to determine the stroke by the stroke determining unit from that of before finishing to determine the stroke.

According to the eighth aspect of the invention, the stroke of the internal combustion engine is determined based on the intake pressure of the intake path, and therefore, even in a state in which the stroke of the internal combustion engine cannot be determined immediately after starting the internal combustion engine, the intake amount sucked to the combustion chamber can be controlled by synchronizing the drive reference position without deviating the intake timing, and excellent engine starting performance and stable idling rotational speed control can be realized.

A ninth aspect of the invention is characterized in that the controlling unit controls to bring about the drive reference position once for each rotation of a crank before finishing to determine the stroke by the stroke determining unit and bring about the drive reference position once for each two rotations of the crank after finishing to determine the stroke in the idle rotational speed controller of an internal combustion engine described in the eighth aspect.

According to the ninth aspect of the invention, in addition to an effect of the eighth aspect, after finishing to determine the stroke, by completely synchronizing the intake timing and the drive reference position, an effect as a fast idle device is further promoted and excellent engine starting performance and stable idling rotational speed control can be realized.

A tenth aspect of the invention is an idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller including: an intake pressure detecting unit for detecting an intake pressure of the intake path; a stroke determining unit for determining a stroke of the internal combustion engine based on at least the intake pressure; and a controlling unit for controlling the control valve by synchronizing a drive reference position for driving to open or close the control valve with a timing of detecting the intake pressure by the intake pressure detecting unit, and preventing the control valve from being driven to open or close before finishing to determine the stroke by the stroke determining unit.

According to the tenth aspect of the invention, in a state in which the stroke of the internal combustion engine immediately after starting the internal combustion engine is difficult to determine since the stroke of the internal combustion engine is determined based on the intake pressure of the intake path, by not driving to open or close the control valve, it can be prevented that the intake pressure detecting unit cannot determine the stroke by erroneously detecting the fluctuation in the pressure caused by operating to open or close the control valve, and excellent engine starting performance and stable idling rotational speed control can be realized.

An eleventh aspect of the invention is an idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller including: an intake pressure detecting unit for detecting an intake pressure of the intake path; a fuel supplying unit for controlling a supply amount of a fuel supplied to the combustion chamber based on at least the intake pressure; and a controlling unit for synchronizing a drive reference position for driving to open or close the control valve with a timing of detecting the intake pressure by the intake pressure detecting unit.

According to the eleventh aspect of the invention, by synchronizing the drive reference position of driving to open or close the control valve with the timing of detecting the intake pressure by the intake pressure detecting unit, it can be prevented that the intake pressure detecting unit erroneously detects the fluctuation in the pressure caused by operating to open or close the control valve and the supply amount of the fuel cannot stably be controlled or the stroke cannot be determined, and stable idling rotation can be carried out.

A twelfth aspect of the invention is characterized in that the controlling unit controls a state of closing the control valve by setting a timing of driving to close the control valve as the drive reference position According to the twelfth aspect of the invention, in addition to an effect of the eleventh aspect, when the idling rotational speed is increased, the control valve is controlled in a direction of restraining the engine rotational speed, and when the idling rotational speed is reduced, the control valve is controlled in a direction of increasing the engine rotational speed, and therefore, the fluctuation in rotation of the internal combustion engine can be restrained.

A thirteenth aspect of the invention is an internal combustion engine including the idle rotational speed controller of an internal combustion engine according to any one of the first to twelfth aspects of the invention.

According to the thirteenth aspect of the invention, there can be realized an internal combustion engine the rotational fluctuation of which is restrained and which is provided with the stable idle rotational speed controller having excellent engine starting performance.

A fourteenth aspect of the invention is a controller of an internal combustion engine including an intake path for sucking air to be supplied to a combustion chamber of the internal combustion engine, a fuel supplying unit for supplying a fuel to the combustion chamber, a throttle valve arranged at the intake path for controlling an intake amount, and intake pressure detecting unit for detecting an intake pressure of the intake path; wherein the fuel supplying unit increases a supply amount of the fuel when a pressure difference of the intake pressure before one cycle or more and a current one is equal to or larger than a threshold in accordance with an engine rotational speed of the internal combustion engine.

According to the fourteenth aspect of the invention, it can be prevented that despite a steady state, the state is erroneously determined to shift to accelerating state and the fuel supply amount is increased, and the fuel can be supplied stably.

A fifteenth aspect of the invention is characterized in that the threshold is set by a two-dimensional table constituting an axis thereof by an engine rotational speed in the internal combustion engine control apparatus described in the fourteenth aspect.

According to the fifteenth aspect of the invention, in addition to an effect of the fourteenth aspect, the threshold is set by the two-dimensional table constituting the axis thereof by the engine rotational speed, and therefore, the fuel can stably be supplied without increasing the fuel supply amount erroneously by a low idling rotational speed at which the fluctuation in rotation is large.

Further, even when a user changes to set the idling rotational speed to be low, stable idling rotational speed control can be carried out without erroneously determining that the state is not the steady state.

A sixteenth aspect of the invention is characterized in that the controlling unit increases the supply amount of the fuel by asynchronous injection in the internal combustion engine control apparatus described in the fourteenth aspect.

According to the sixteenth aspect of the invention, in addition to an effect described in the fourteenth aspect, the supply amount of the fuel is increased by the asynchronous injection, and therefore, the fuel can be supplied swiftly and stably.

A seventeenth aspect of the invention is an internal combustion engine including the controller of an internal combustion engine according to any one of the fourteenth to sixteenth aspects.

According to the seventeenth aspect of the invention, there can be realized an internal combustion engine the rotational fluctuation of which is restrained and which includes the controller of the internal combustion engine having excellent engine starting performance and carrying out stable idling rotational speed control.

Figure 1:
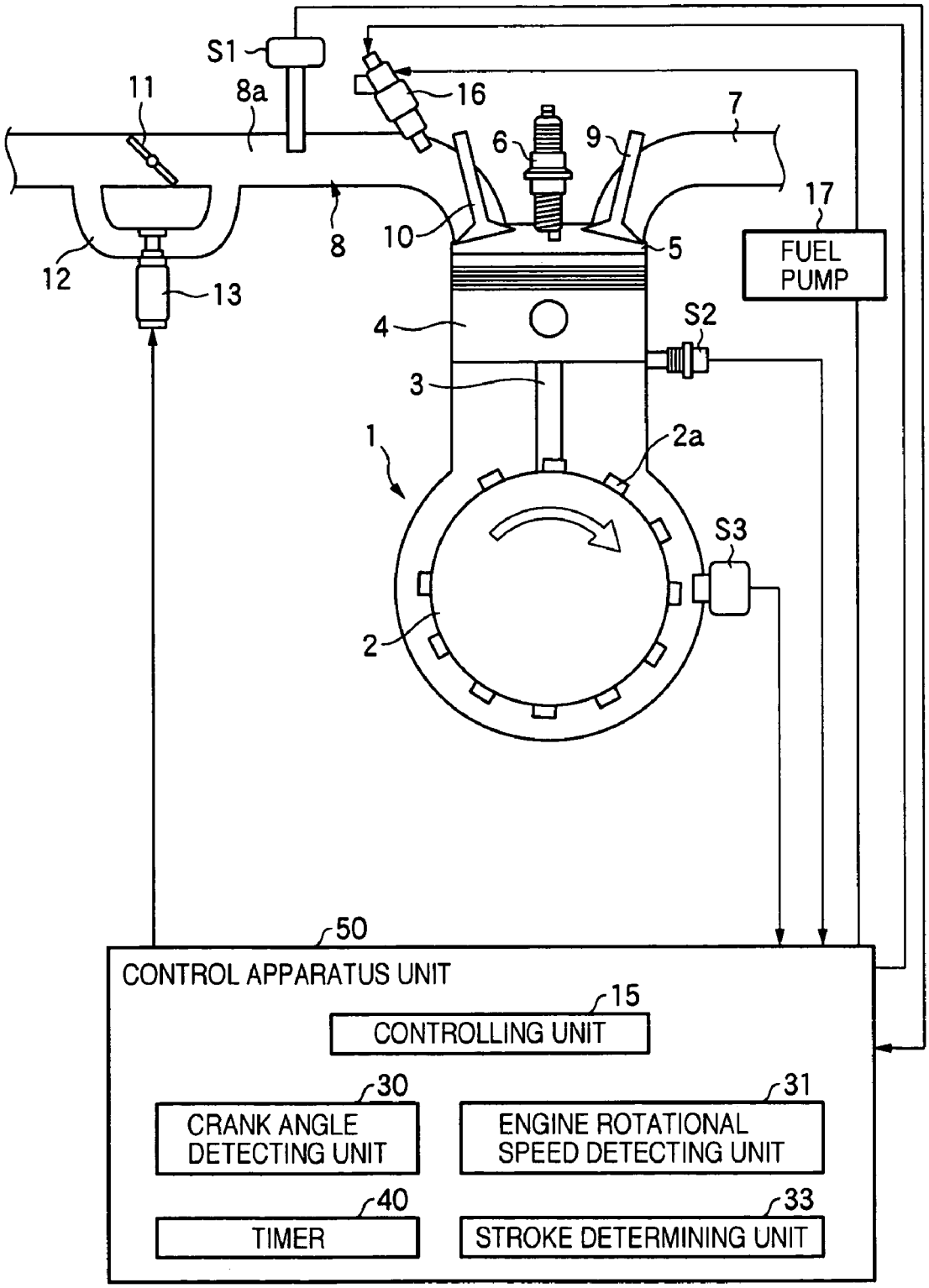
FIG. 1 is a constitution view substantially showing the whole of an idle rotational speed controller of an internal combustion engine.

Incidentally, in the drawings, numeral 1 designates an internal combustion engine, numeral 2 designates a crank, numeral 8 designates an intake path, numeral 11 designates a throttle valve, numeral 12 designates an auxiliary intake path, numeral 13 designates a control valve, numeral 15 designates controlling unit, numeral 17 designates a fuel supplying unit, numeral 30 designates crank angle detecting unit, numeral 31 designates engine rotational speed detecting unit, numeral 33 designates stroke determining unit, notation S1 designates an intake pressure detecting unit, notation S2 designates an engine temperature detecting unit, notation S3 designates a crank pulse output detecting unit, and numeral 50 designates a control apparatus unit.

BEST MODE FOR CARRYING OUT THE INVENTION

Although a detailed explanation will be given of an embodiment of an idle rotational speed controller of an internal combustion engine according to the invention in reference to the drawings as follows, the invention is not limited to the embodiment. Further, the embodiment of the invention shows the most preferred mode of the invention, and technical terms of the invention are not limited thereto.

Figure 2:
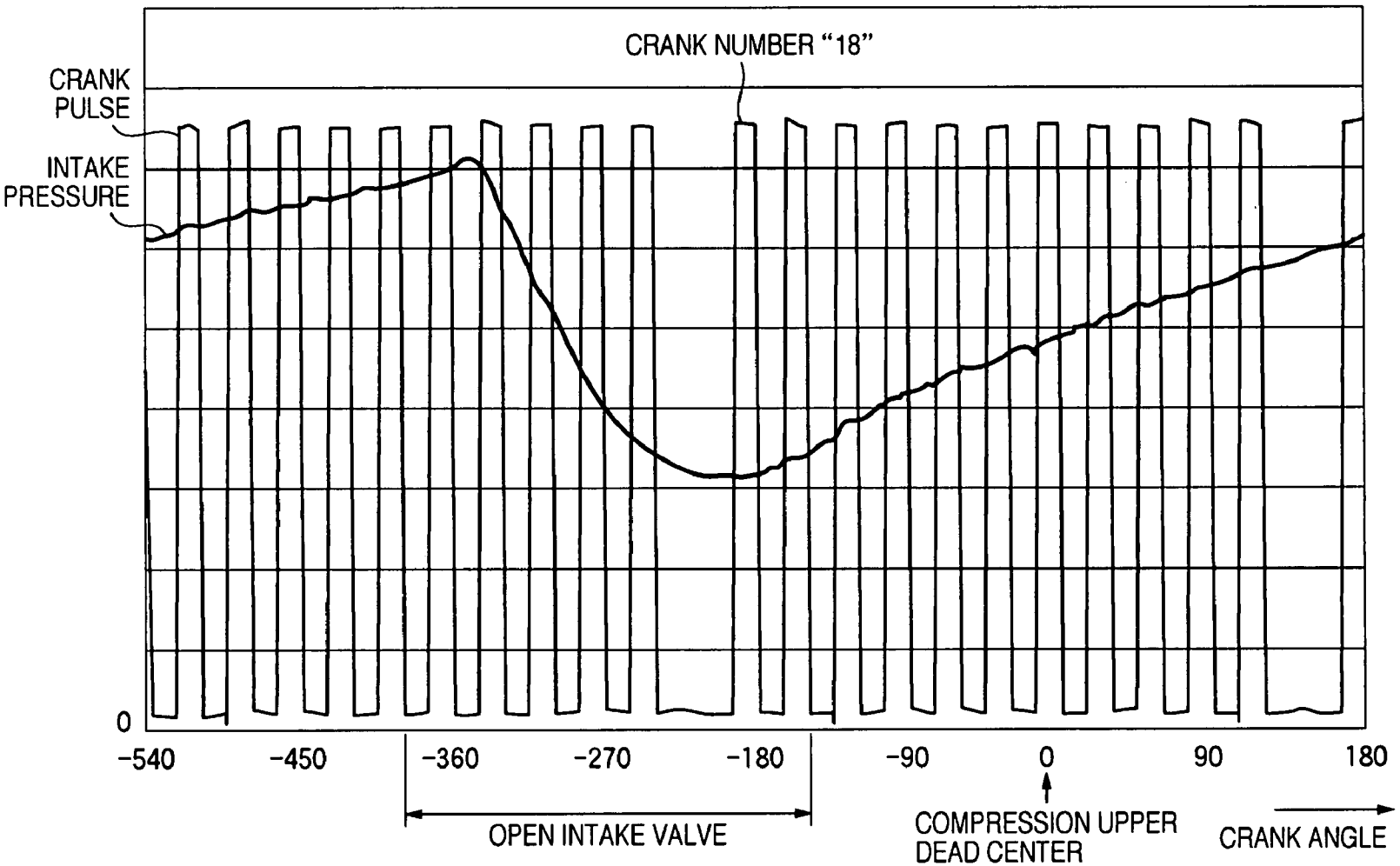
FIG. 2 is a diagram showing a relationship between a crank angle and an intake pressure.
Figure 3:
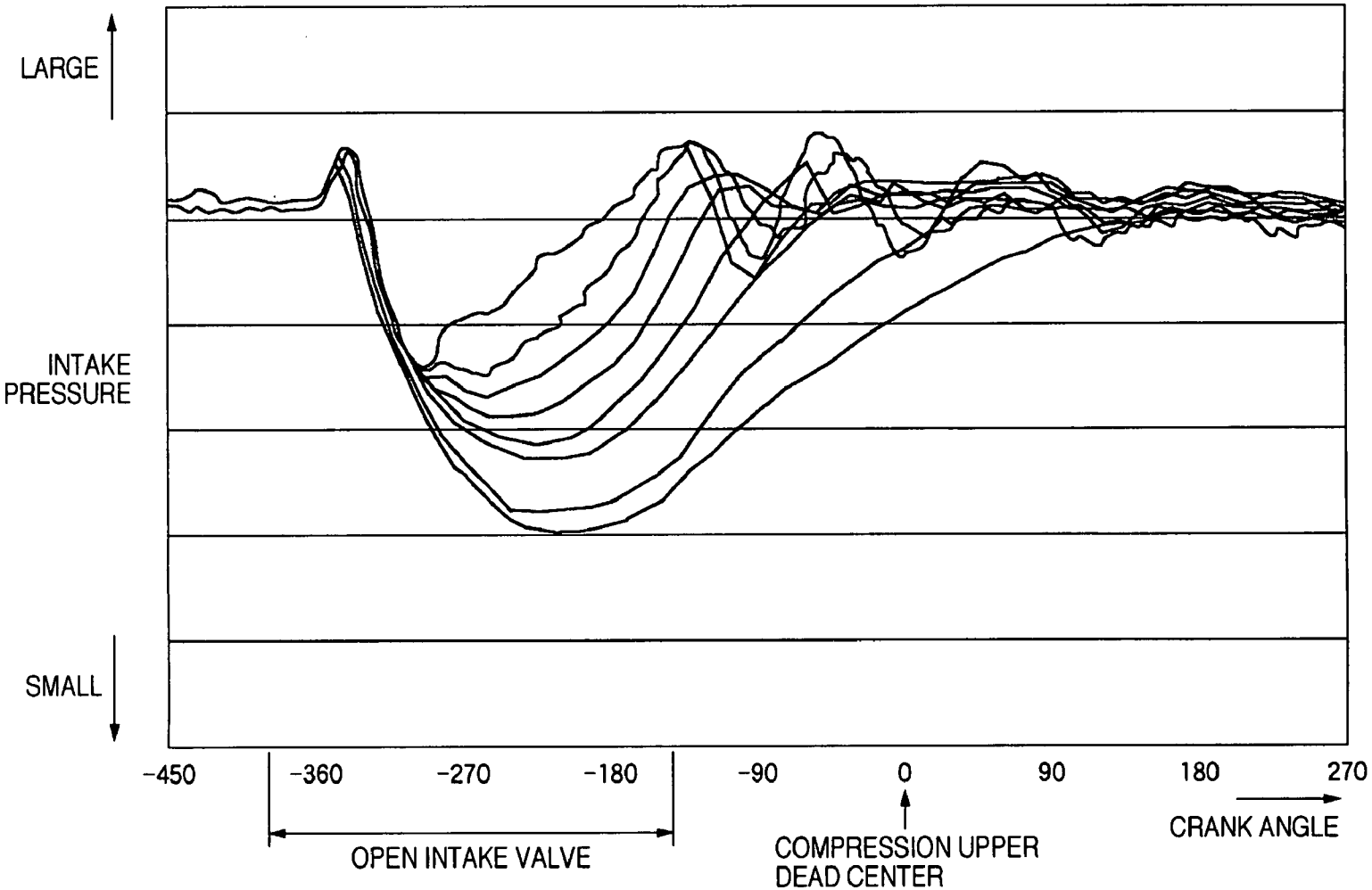
FIG. 3 is a diagram showing a relationship between a crank angle and an intake pressure when a throttle opening degree is changed.
Figure 4:
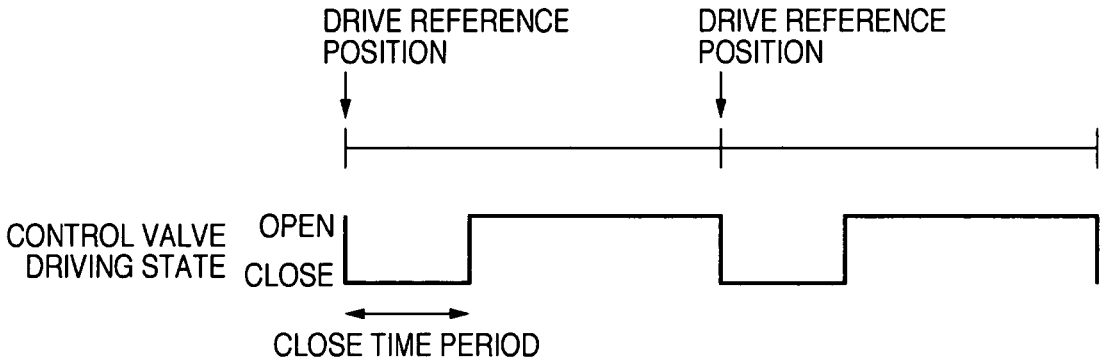
FIG. 4 is a diagram showing a state of driving to open and close a control valve.
Figure 5:
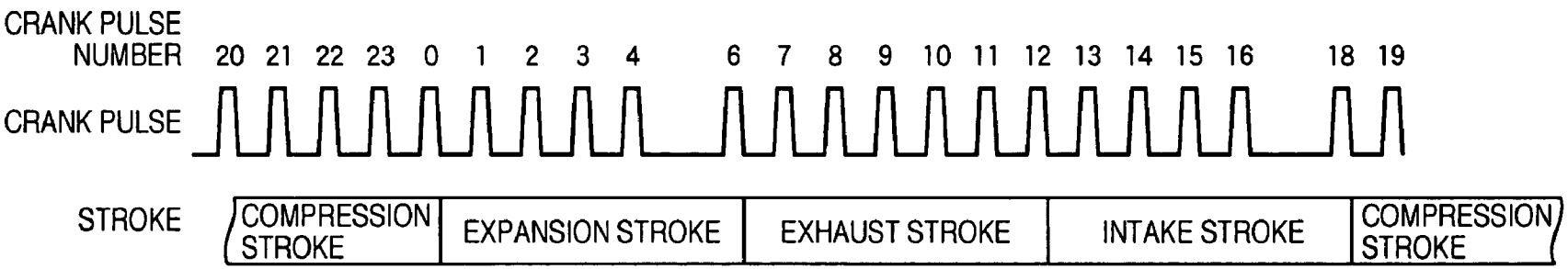
FIG. 5 is a diagram showing a crank pulse and a stroke.
Figure 6:
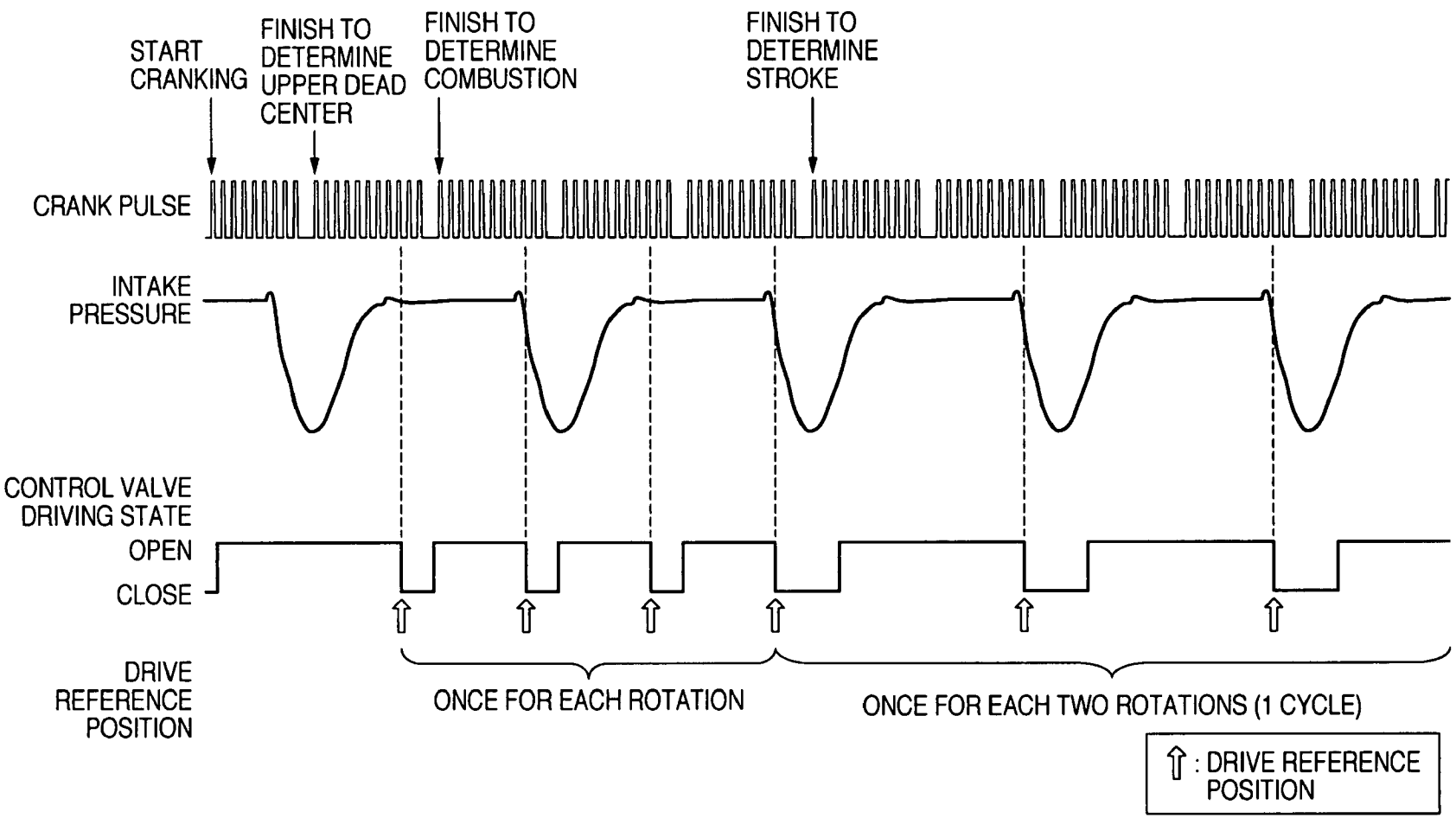
FIG. 6 is a diagram showing timings of a crank pulse, determination of a stroke, detection of an intake pressure, and a state of driving a control valve.

FIG. 1 is a constitution view substantially showing the whole of an idle rotational speed controller of an internal combustion engine, FIG. 2 is a diagram showing a relationship between a crank angle and an intake pressure, FIG. 3 is a diagram showing a relationship between the crank angle and the intake pressure when a throttle opening degree is changed, FIG. 4 is a diagram showing a state of driving to open and close a control valve, FIG. 5 is a diagram showing a crank pulse and a stroke, and FIG. 6 is a diagram showing the crank pulse, determination of the stroke, detection of the intake pressure, and a state of driving the control valve.

Although the internal combustion engine 1 of the embodiment shows an internal combustion engine of a single cylinder, the embodiment is applicable also to an internal combustion engine of multi cylinders. According to the internal combustion engine 1, the crank 2 is connected to a piston 4 via a connecting rod 3, and the crank is rotated in an arrow mark direction by reciprocating the piton 4. The internal combustion engine 1 is provided with an ignition plug 6 that faces to a combustion chamber 5, and the combustion chamber 5 is opened with an exhaust path 7 and the intake path 8. An opening of the exhaust path 7 is opened and closed by an exhaust valve 9, an opening of the intake path 8 is opened and closed by an intake valve 10, and the exhaust valve 9 and the intake valve 10 are opened and closed in synchronism with rotation of the crank 2.

The throttle valve 11 is arranged at a middle of the intake path 8 and the throttle valve 11 controls an intake amount for sucking air to be supplied to the combustion chamber 5. The intake path 8 is provided with the auxiliary intake path 12 for communicating an upstream side and a downstream side by bypassing the throttle valve 11, and the auxiliary intake path 12 is provided with the control valve 13 of an opening/closing type for controlling an idling intake amount.

As shown in FIG. 2, the intake pressure immediately after opening the intake valve 10 is high. When the piston 4 is moved down, the intake pressure is reduced and when the intake valve 10 is closed, the intake pressure is increased. A crank number of "0" designates a compression upper dead center.

As shown in FIG. 3, the intake pressure is changed by a throttle opening degree. That is, as the throttle opening degree is increased, a reduction in the intake pressure when the intake valve 10 is opened is reduced. The crank angle of "0" designates the compression upper dead center.

The control valve 13 of the embodiment is constituted by a solenoid valve and opens/closes the auxiliary intake path 12 by being controlled by a controlling unit 15 provided at a control apparatus unit 50.

The controlling unit 15 is constituted by CPU, RAM, ROM and the like. As shown in FIG. 4, a drive reference position is constituted by a timing of driving to close the control valve 13 and by controlling a time period of closing the control valve 13, a ratio of a time period of opening the control valve 13 within a predetermined time period is controlled (duty control) to thereby drive to open and close the control valve 13. Further, an idle intake amount is controlled by setting the drive reference position and the time period of closing the control valve.

The intake path 8 is provided with a fuel injection valve 16 on a downstream side of a portion of communicating the throttle valve 11 and the auxiliary intake path 12. The fuel injection valve 16 constitutes fuel supplying unit along with the fuel pump 17 and the like and a fuel injection amount is controlled by the controlling unit 15 electrically connected thereto.

Further, the intake path 8 is provided with an intake pressure detecting unit S1 on the downstream side of the portion of communicating the throttle valve 11 and the auxiliary intake path 12. The intake pressure detecting unit S1 detects the intake pressure of the intake path 8 on the downstream side of the auxiliary intake path 12 and transmits information of the detected intake pressure to the controlling unit 15.

The controlling unit 15 predicts a steady state load by the intake pressure at a predetermined position of a crank angle of the internal combustion engine 1 and determines a fuel supply amount of the fuel supplying unit, and therefore, the fuel can be supplied with high accuracy based on the intake pressure. The fuel supply amount determined by the controlling unit 15 is a fuel supply amount for a next cycle.

The fuel can be supplied with high accuracy by making the intake path 8 and the auxiliary intake path 12 merge to communicate with the single combustion chamber 5 of the internal combustion engine 1. The fuel can be supplied with high accuracy based on the intake pressure by arranging the intake pressure detecting unit S1 on a downstream side of a merging portion 8*a* at which the intake path 8 and the auxiliary intake path 12 merge and detecting the intake pressure.

Further, the internal combustion engine 1 is provided with an engine temperature detecting unit S2. The engine temperature detecting unit S2 detects an engine temperature and transmits information of the detected engine temperature to the controlling unit 15. Further, the internal combustion engine 1 is provided with a crank pulse outputting unit S3. The crank pulse outputting unit S3 outputs a crank pulse produced by a projection 2*a* of the rotating crank 2 and transmits the crank pulse to the controlling unit 15.

Further, the control apparatus unit 50 is provided with a crank angle detecting unit 30, an engine rotational speed detecting unit 31, a stroke determining unit 33 and the like other than the controlling unit 15. The crank angle detecting unit 30 detects a crank angle of the crank 2 by the crank pulse produced by the crank pulse outputting unit S3. The engine rotational speed detecting unit 31 detects an engine rotational speed by the crank pulse produced by the crank pulse outputting unit S3. The controlling unit 15 controls the fuel supply amount by driving the fuel injection valve 16 and the fuel pump 17 in the fuel supplying unit based on the intake pressure and the engine rotational speed.

In determining the stroke by the stroke determining unit 33, as shown in FIG. 5, when 11 pieces of the projections 2*a* are provided at equal intervals except a position of one portion at positions constituted by dividing 360 degrees of the crank 2 by 12, a crank pulse number is attached to a crank pulse produced by the projection 2*a*. A crank pulse number at a compression dead center is designated by "0". It is determined that the crank pulse numbers of "0" through "6" designate an expansion stroke, the crank pulse numbers of "6" through "12" designate an exhaust stroke, the crank pulse numbers of "12" through "18" designate an intake stroke, and the crank pulse numbers of "18" through "0" designate a compression stroke.

As shown in FIG. 6, when cranking is stated by starting the internal combustion engine 1, the crank pulse is outputted, and the intake pressure is increased. The intake pressure is reduced when the crank pulse is not outputted, and the upper dead center is finished to be determined by a timing at which the crank pulse is not outputted.

Further, the intake pressure is increased, combustion is carried out and combustion is finished to be determined by the timing at which the crank pulse is not outputted. The strokes are finished to be determined by repeating these twice. Until finishing to determine the strokes, the drive reference position is controlled to constitute the timing for each one rotation, and after finishing to determine the strokes, the drive reference position is controlled to constitute the timing once for each two rotations of the crank.

Figure 7:
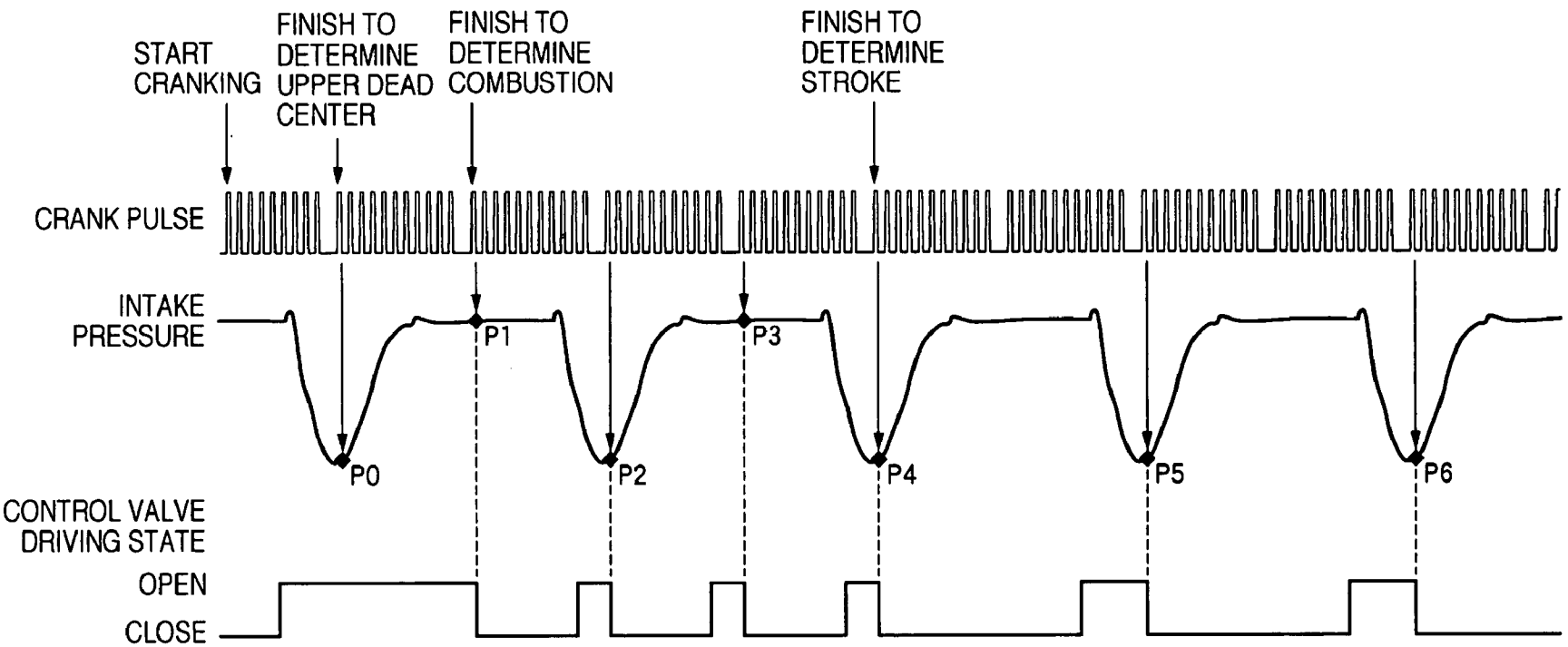
FIG. 7 is a diagram showing timings of a crank pulse, determination of a stroke, detection of an intake pressure, and a state of driving a control valve according to a first embodiment.

A first embodiment of the invention is constituted as shown in FIG. 7.

The first embodiment includes the crank angle detecting unit 30 for detecting the crank angle of the crank 2 by the crank pulse produced by the crank 2, the intake pressure detecting unit S1 for detecting the intake pressure of the intake path 8 on the downstream side of the auxiliary intake path 12, the stroke determining unit 33 for determining the stroke of the internal combustion engine 1 based on the crank pulse and a change in the intake pressure, and the controlling unit 15 for controlling the control valve 13 by controlling a state of closing the control valve 13 by setting the drive reference position as the timing of driving to close the throttle valve 13. The controlling unit 15 synchronizes the timing of driving the control valve 13 based on the crank angle with the timing of detecting the intake pressure.

That is, in FIG. 7, when cranking is started by starting the internal combustion engine 1, the crank pulse is outputted, the intake pressure is increased, and the controlling unit 15 drives to open and close the control valve 13 by controlling a ratio of a time period of closing the control valve 13 to a time period of opening the control valve in a predetermined time period to open the auxiliary intake path 12. The intake pressure is reduced by rotating the crank 2 by the cranking, the upper dead center is finished to be determined at the timing at which the crank pulse is not outputted, and the intake pressure at this occasion is designated by notation P0. The intake pressure is then increased, combustion is carried out, and the combustion is finished to be determined by the timing at which the crank pulse is not outputted. The intake pressure at this occasion is designated by notation P1. The timing of driving to close the control valve 13, which is set as the drive reference position, is synchronized with the timing for detecting the intake pressure, and the control valve 13 closes the auxiliary intake path 12.

Further, the crank pulse is outputted after finishing to determine the combustion, and when a predetermined time period of closing the control valve has elapsed, the state of driving the control valve 13 is made to be opened to open the auxiliary intake path 12. The intake pressure at the timing at which the crank pulse is not outputted is designated by notation P2, and the state of driving the control valve 13 synchronized with the timing of detecting the intake pressure is closed to close the auxiliary intake path 12.

Subsequently, as the crank pulse is outputted, the intake pressure is increased and combustion is carried out. When a predetermined time period of closing the control valve has elapsed, the state of driving the control valve 13 is opened to open the auxiliary path 12, the intake pressure at a timing at which the crank pulse is not outputted is designated by notation P3, and the state of driving the control valve 13 synchronized with the timing of detecting the intake pressure is closed to close the auxiliary intake path 12.

Further, the upper dead center is finished to be determined at a timing at which the crank pulse is not outputted, the intake pressure at this occasion is designated by notation P4 and the stroke is finished to be determined.

Until finishing to determine the strokes, the drive reference position for driving to close the control valve 13 is controlled to be once for each rotation of the crank and when combustion is finished to be determined and the intake pressure is at P1, the control valve 13 driven to close in synchronism with the timing of detecting the intake pressure closes the auxiliary intake path 12. When combustion is finished to be determined and the intake pressure is at P1, the state of driving the control valve is controlled to be once for each rotation of the crank by setting the drive reference position as a time point of closing the state of closing the control valve. Thereafter, until finishing to determine the strokes, the intake pressures P2, P3 constitute the drive reference positions.

When the stroke is finished to be determined, the drive reference position of driving to close the control valve 13 thereafter is controlled to be once for each two rotations (1 cycle) of the crank to constitute the drive reference position in synchronism with the intake pressures P4, P5 . . . .

When compared with FIG. 6, in FIG. 7, the timing of driving to close the control valve 13 based on the crank angle is synchronized with the timing of detecting the intake pressure. By synchronizing the timing of driving to open or close the control valve 13 in this way with the timing of detecting the intake pressure, a fluctuation in the intake pressure at a crank pulse the same as a crank pulse one cycle before can be restrained to be small, a fluctuation in the intake pressure caused by opening or closing the control valve 13 is prevented from being detected erroneously, and the steady state load can be detected further accurately.

In this way, the idling rotational speed of the internal combustion engine 1 is controlled by controlling the intake air amount immediately after starting. At this occasion, the idling rotational speed can stably be controlled without determining that the state is not brought into the steady state by a change in the intake pressure caused by opening or closing the control valve 13, and the stroke can be determined without fail even in a system which is not provided with the stroke determining sensor by determining the stroke of the internal combustion engine 1 by detecting the intake pressure of the intake path 8.

Figure 8:
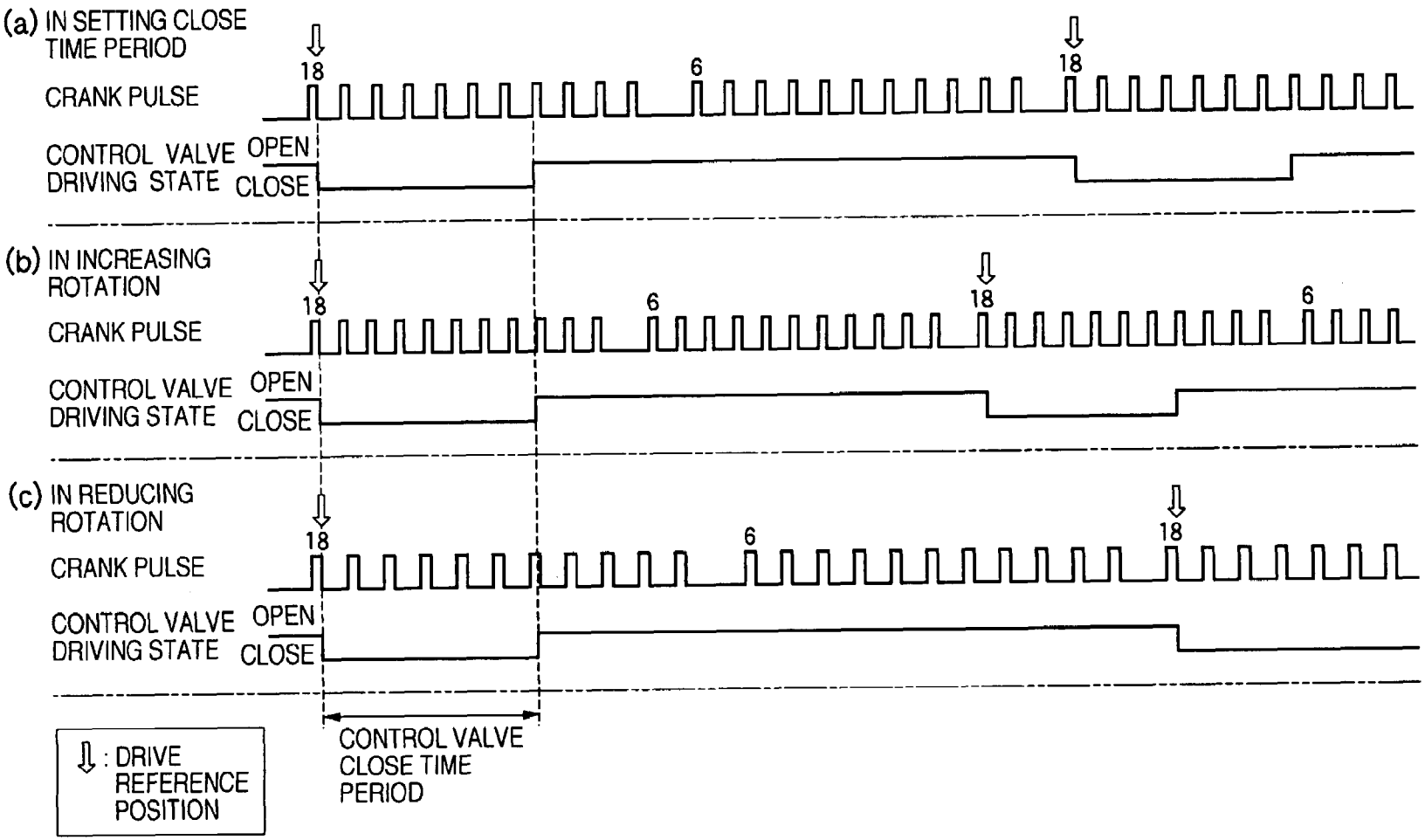
FIG. 8 is a diagram showing a timing of a reference position of driving a control valve according to a second embodiment.

A second embodiment of the invention is constituted as shown in FIG. 8.

The embodiment includes the crank angle detecting unit 30 for detecting the crank angle of the crank 2 by the crank pulse produced by the crank 2 and the control valve 13.

As shown in FIG. 8(*a*), the controlling unit 15 constitutes the drive reference position by the timing of driving to close the control valve 13 and the time period of closing the control valve constituting the state of closing the control valve 13 is controlled by a timer 40 provided to the controlling unit 15.

That is, the control is executed by the time period of closing the control valve. As shown in FIG. 8(*b*), when the engine rotation is increased, the control valve opening time period of the control valve 13 is shortened in accordance with an increase in the number of the crank pulses in the control valve closing time period of the control valve 13. Meanwhile, as shown in FIG. 8(*c*), when the engine rotation is reduced, the time period of opening the control valve 13 is made to be long in accordance with a reduction in the number of crank pulses in the control valve closing time period of the control valve 13.

In this way, by making the time period of opening the control valve short in accordance with the increase in the number of crank pulses in the control valve closing time period of the control valve 13 and making the time period of opening the control valve long in accordance with the reduction in the number of crank pulses, when the idling rotational speed is increased, the control valve is controlled in a direction of restraining the engine rotational speed, and when the idling rotational speed is reduced, the control valve is controlled in a direction of increasing the engine rotational speed. Therefore, the fluctuation in rotation of the internal combustion engine can be restrained.

Although according to the second embodiment of the invention, the control valve closing time period is controlled by the timer 40, for example, the control valve closing time period can also be controlled with respect to a position by the crank angle of the crank 2.

Figure 9:
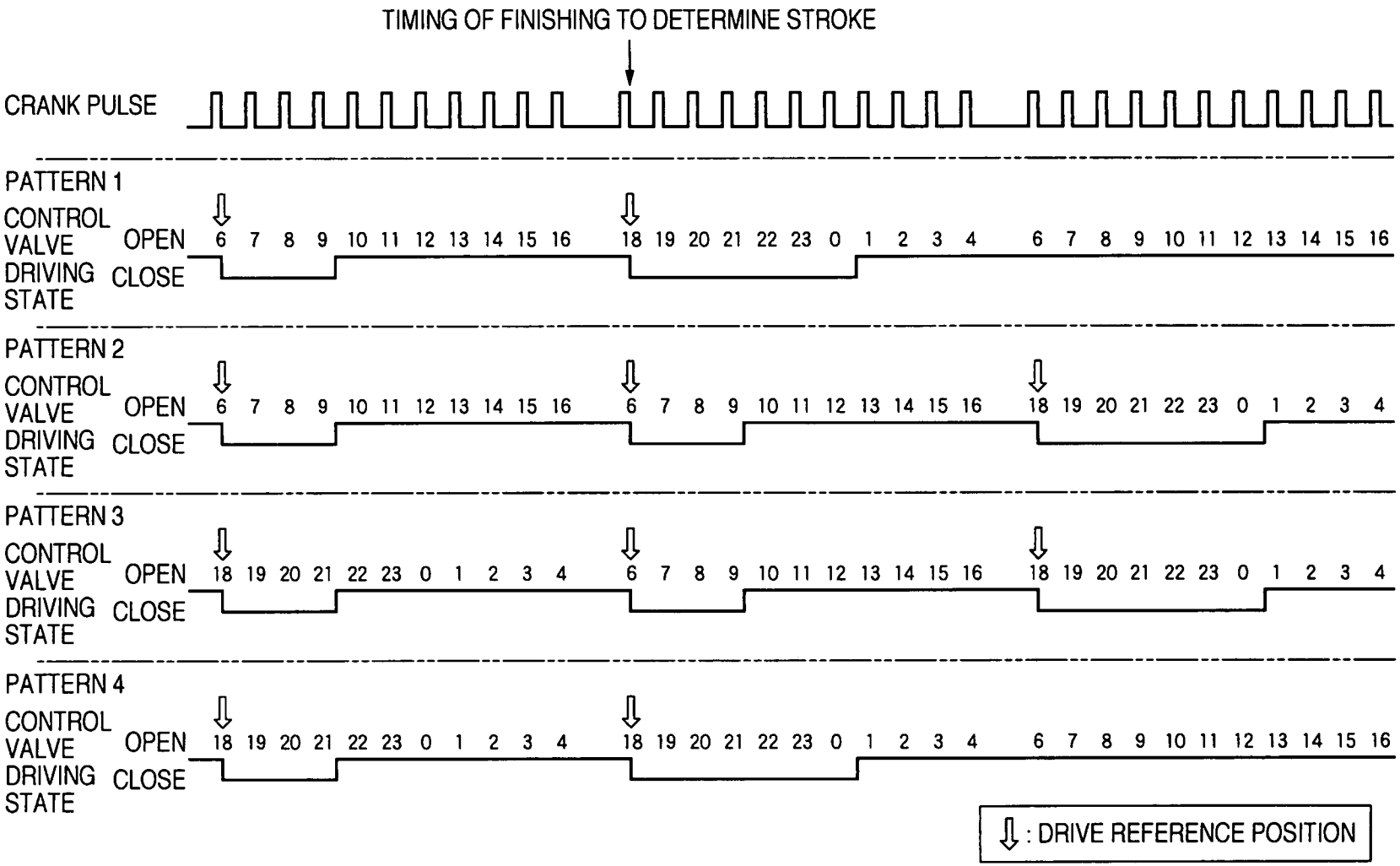
FIG. 9 is a diagram showing a timing of a reference position of driving a control valve according to a third embodiment.

A third embodiment of the invention is constituted as shown in FIG. 9.

The third embodiment includes the crank angle detecting unit 30 for detecting the crank angle of the crank by the crank pulse produced by the crank, the intake pressure detecting unit S1 for detecting the intake pressure of the intake path 8 on the downstream side of the auxiliary path 12, the stroke determining unit 33 for determining the stroke of the internal combustion engine 1 by the crank pulse and a change in the intake pressure, and the controlling unit 15 for controlling the state of closing the control valve 13 by constituting the drive reference position by the timing of driving to close the control valve 13.

The controlling unit 15 synchronizes the timing of driving to close the control valve 13 based on the crank angle with a stroke determination finish timing as the drive reference position, and the drive reference position with respect to a crank rotation of the internal combustion engine 1 is changed before and after finishing to determine the stroke.

That is, in pattern 1 and pattern 4, after finishing to determine the stroke, even when the drive reference position of driving to close the control valve 13 is changed, two rotations of the crank are controlled by constituting the drive reference position, in which the control valve 13 is closed in the crank numbers of "18" through "0" and opened in crank numbers "1" through "18".

Meanwhile, in pattern 2 and pattern 3, after finishing to determine the stroke, when the drive reference position of driving to close the control valve 13 is changed, the crank numbers of "6" through "18" constitute the time period of controlling the control valve 13. After finishing to determine the stroke, when the crank 2 is rotated by one rotation or more until reaching the initial crank angle of detecting the intake pressure, the control valve 13 is closed at the crank numbers of "6" through "9", and the control valve 13 is opened at the crank numbers of "10" through "18". A time period of not driving the control valve 13 is eliminated, from the crank number "18", the control valve 13 is driven to open and close similar to pattern 1 and pattern 4, and stable idling rotational speed control can be realized by eliminating the time period of not driving the control valve 13 in changing the drive reference position.

According to the third embodiment, the drive reference position is varied before and after finishing to determine the stroke, and after finishing to determine the stroke, the drive reference position is controlled to be synchronized with an initial predetermined crank angle.

That is, although in pattern 1 and pattern 2, the control valve 13 is closed at the crank number of "6" of the drive reference position of driving to close the control valve 13 before finishing to determine the stroke, in pattern 3 and pattern 4, the control valve 13 is closed at the crank number of "18" of the drive reference position of driving to close the control valve 13, and the control is executed by constituting the reference by the crank number of "6" or "18", after finishing to determine the stroke, in any of pattern 1 through pattern 4, for example, the control valve 13 is closed at the crank number of "18" and the control is executed by constituting the reference by the crank number of "18". In this way, the drive reference position is varied before and after finishing to determine the stroke, after finishing to determine the stroke, the control is executed by synchronizing the drive reference position of driving to close the control valve 13 with the initial predetermined crank angle, or the crank number of "18" according to the embodiment and the idling rotational speed control which is stable with a small variation in rotation can be realized.

Further, according to the third embodiment of the invention, the drive reference position is varied before and after finishing to determine the stroke, before finishing to determine the stroke, the control valve 13 is controlled to open fully and after finishing to determine the stroke, the control valve 13 is controlled in accordance with a state of operating the internal combustion engine. That is, before finishing to determine the stroke, the control valve 13 is controlled to open fully, as shown in FIG. 8(*b*), when the engine rotation is increased, the time period of opening the control valve 13 is shortened in accordance with the increase in the number of crank pulses in the time period of closing the control valve 13. On the other hand, as shown in FIG. 8(*c*), when the engine rotation is reduced, the time period of opening the control valve 13 is made to be long in accordance with the reduction in the number of crank pulses in the time period of closing the control valve 13, and the idling rotational speed can be realized to control stably with a smaller fluctuation in rotation by driving to open or close the control valve 13 in accordance with the state of the internal combustion engine.

Further, according to the third embodiment of the invention, the drive reference position is varied before and after finishing to determine the stroke, before finishing to determine the stroke, as shown in FIG. 6, the drive reference position is controlled once for each rotation of the crank 2, after finishing to determine the stroke, the drive reference position is controlled once for two rotations of the crank angle 2, thereby, the idling rotational speed can be realized to control stably with smaller fluctuation in rotation.

After finishing to determine the stroke, by completely synchronizing the intake timing and the drive reference position, an effect as a fast idle device is further promoted, and excellent engine starting performance and stable idling rotational speed control can be realized.

Figure 10:
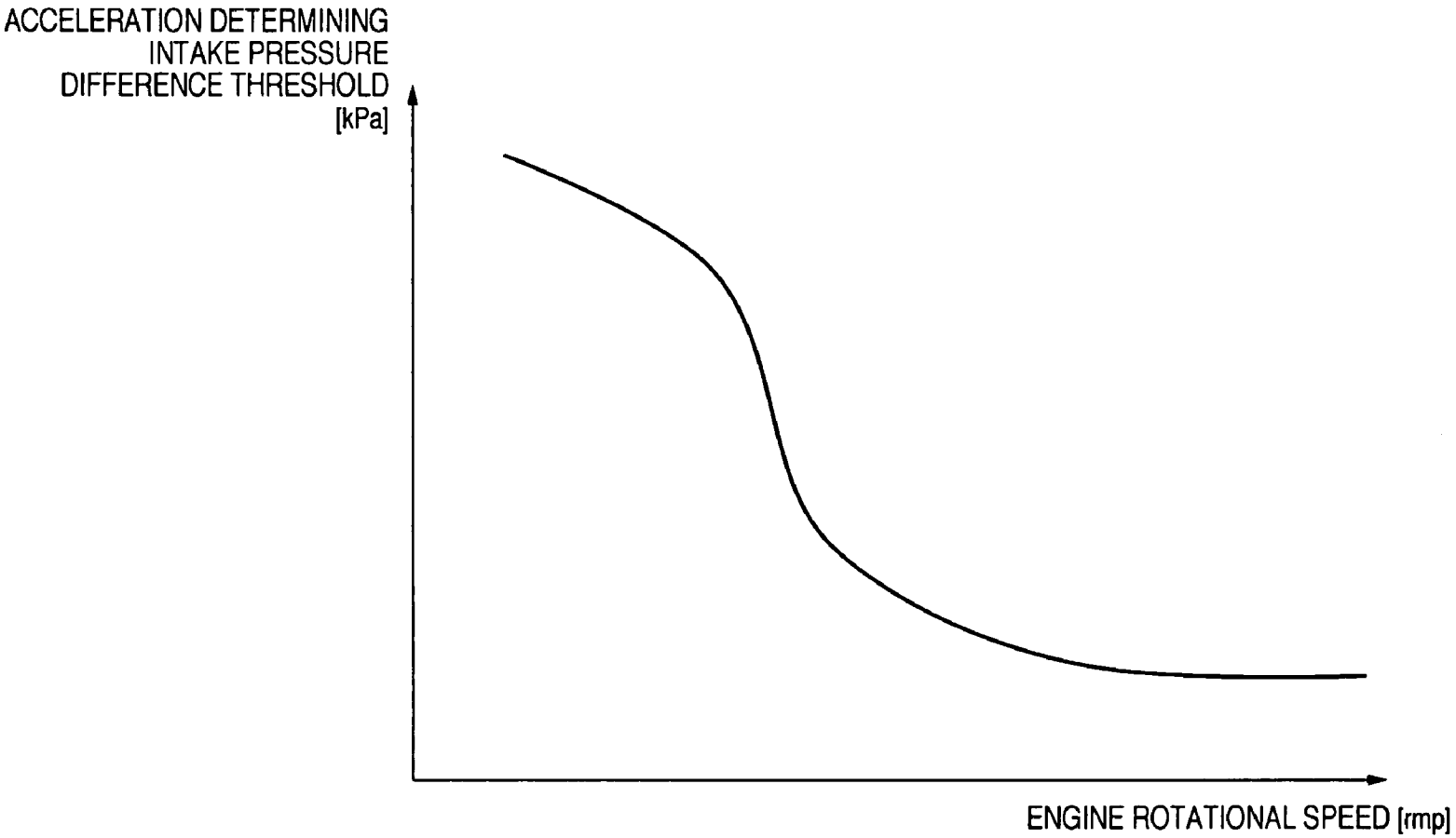
FIG. 10 is a diagram showing a threshold of a pressure difference between an intake pressure before one cycle and a current intake pressure by a two-dimensional table constituting an axis thereof by an engine rotational speed according to a fourth embodiment.

A fourth embodiment of the invention is constituted as shown in FIG. 10.

The fourth embodiment includes the engine rotational speed detecting unit 31 for detecting the engine rotational speed by the crank pulse produced by the crank 2, the intake pressure detecting unit S1 for detecting the intake pressure of the intake path 8 on the downstream side of the auxiliary intake path 12, and fuel supplying unit for supplying fuel to the combustion chamber 5. The fuel supplying unit delivers fuel from the fuel pump 17 to the fuel injection valve 16 and fuel is supplied to the combustion chamber 5 by the fuel injection valve 16. Although fuel is supplied from the fuel injection valve 16 to the combustion chamber 5 via the intake path 8, the invention is not limited thereto, and the fuel may be supplied from the fuel injection valve 16 directly to the combustion chamber 5. Further, the fuel supplying unit can also be constituted by an electronically controlled carburetor and the fuel pump.

The controlling unit 15 controls the fuel supply amount supplied to the combustion chamber 5 based on the intake pressure and the engine rotational speed, and the controlling unit 15 is provided with a threshold of a pressure difference between the intake pressure before one cycle which is required for determining an accelerating or decelerating state of the engine rotational speed and the current intake pressure. The threshold of the pressure difference between the intake pressure before one cycle which is required for determining the accelerating or decelerating state of the engine rotational speed and the current intake pressure is set by a two-dimensional table constituting an axis thereof by the engine rotational speed as shown in FIG. 10.

When the engine rotational speed is small, the threshold of the pressure difference between the intake pressure before one cycle and the current intake pressure is increased, and when the engine rotational number is increased, the threshold is successively reduced and when a predetermined engine rotational speed is reached, the threshold is made to be constant at a small value.

In this way, by setting the threshold of the pressure difference between the intake pressure before one cycle which is required for determining the accelerating or decelerating state when the engine rotational speed is small and the current intake pressure by the two-dimensional table constituting the axis thereof by the engine rotational speed, the fuel can be supplied stably without increasing the fuel supply amount erroneously by a low idling rotational speed having a large fluctuation in rotation.

Further, even when a user sets the idling rotational speed to be low, the idling rotational speed can stably be maintained without being erroneously determined not to be in the steady state.

Further, when a change in the pressure difference between the intake pressure before one cycle and the current intake pressure is equal to or larger than the threshold in accordance with the engine rotational number, the fuel supply amount is increased and fuel can be supplied stably. Further, fuel can be supplied stably by increasing the fuel supply amount by asynchronous injection.

Next, an explanation will be given of a control of an idle rotational speed controller of an internal combustion engine in reference to flowcharts of FIG. 11 and FIG. 12 and a timing chart of FIG. 13.

Figure 11:
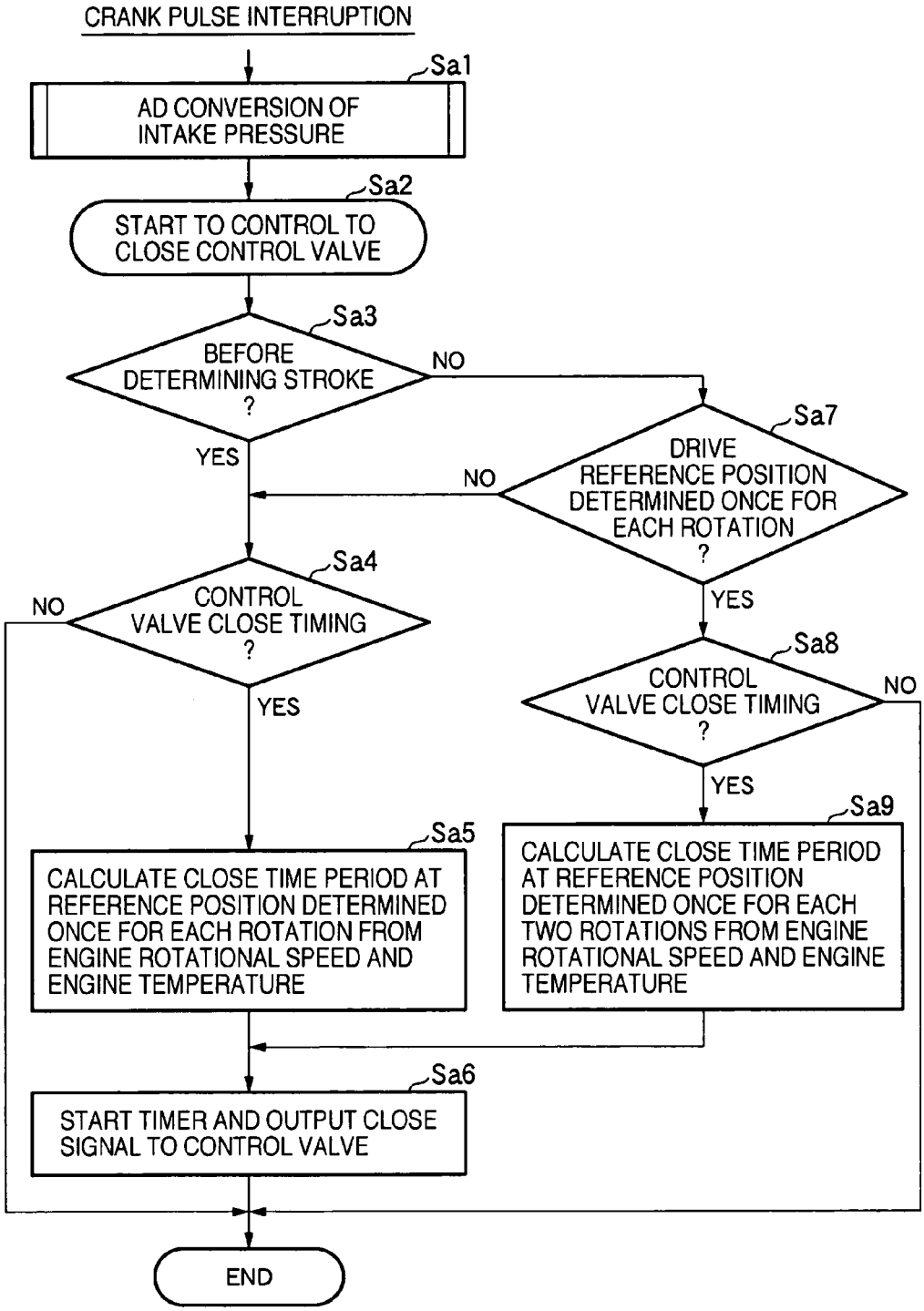
FIG. 11 is a diagram showing a flow of a crank pulse interruption.

FIG. 11 shows a crank pulse interruption flow. When cranking is started by starting the internal combustion engine 1, the intake pressure is increased and the intake pressure is converted by AD conversion to input (Sa 1).

The control valve (solenoid valve) 13 is started to be controlled to close (Sa 2), and it is determined whether the timing is before determining the stroke (Sa 3).

In the case of before determining the stroke, at a timing of closing the control valve 13 (Sa 4), a time period of closing the control valve 13 at the drive reference position of once for each rotation is calculated from the engine rotational speed and the engine temperature (Sa 5), and the timer 40 is started to output the close signal to the control valve 13 (Sa 6).

Meanwhile, in the case of after determining the stroke, it is determined whether the drive reference position is determined once for each rotation (Sa 7), and at a timing of closing the control valve 13 (Sa 8), the time period of closing the control valve 13 at the drive reference position is determined once for two rotations from the engine rotational speed and the engine temperature (Sa 9). The timer 40 is started and the close signal is outputted to the control valve 13 (Sa 6).

Figure 12:
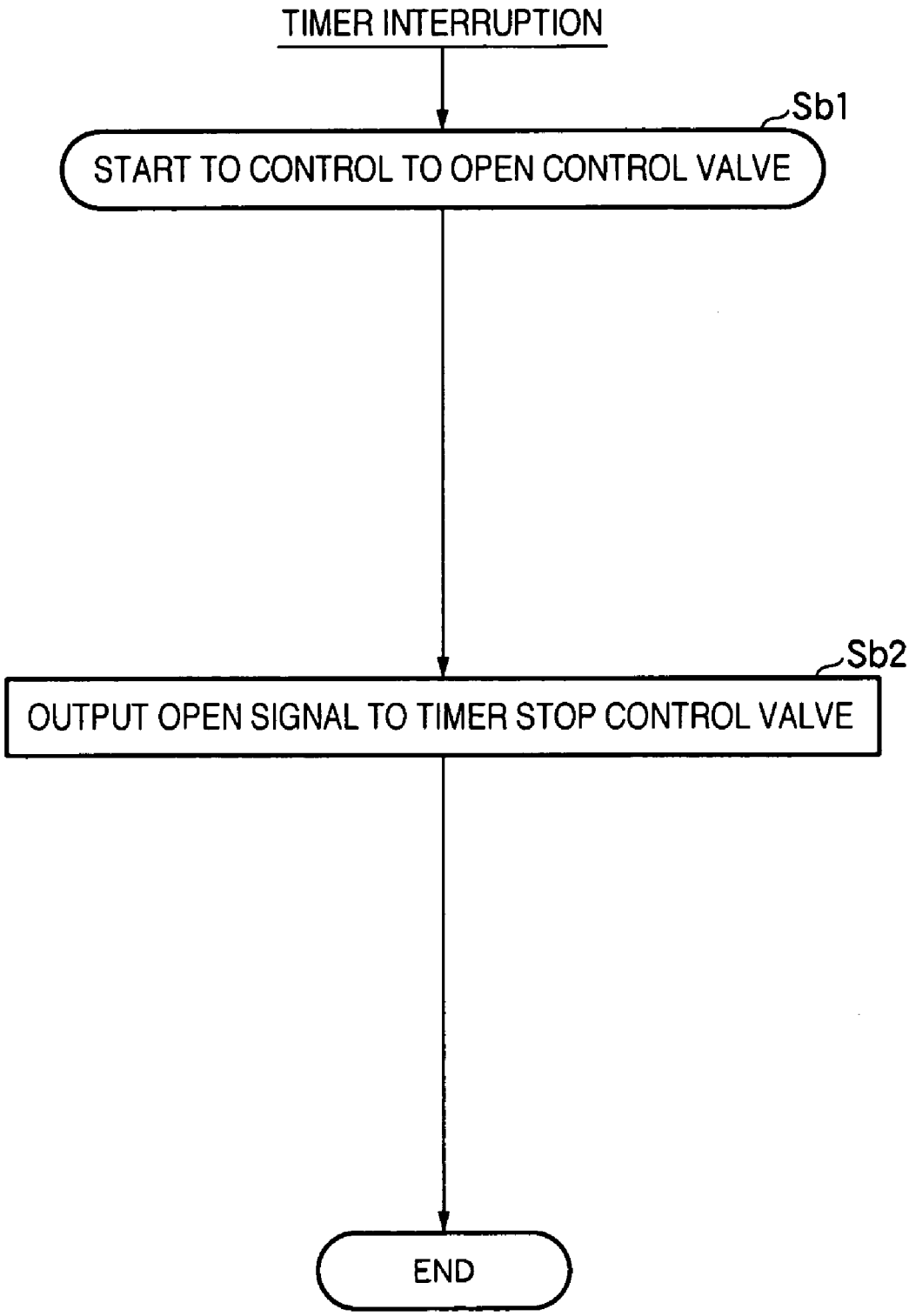
FIG. 12 is a diagram showing a flow of a timer interruption.

FIG. 12 shows a timer interruption flow. When the control of opening the control valve 13 is started (Sb 1), and when the timer is stopped, the open signal is outputted to the control valve 13 (Sb 2).

Figure 13:
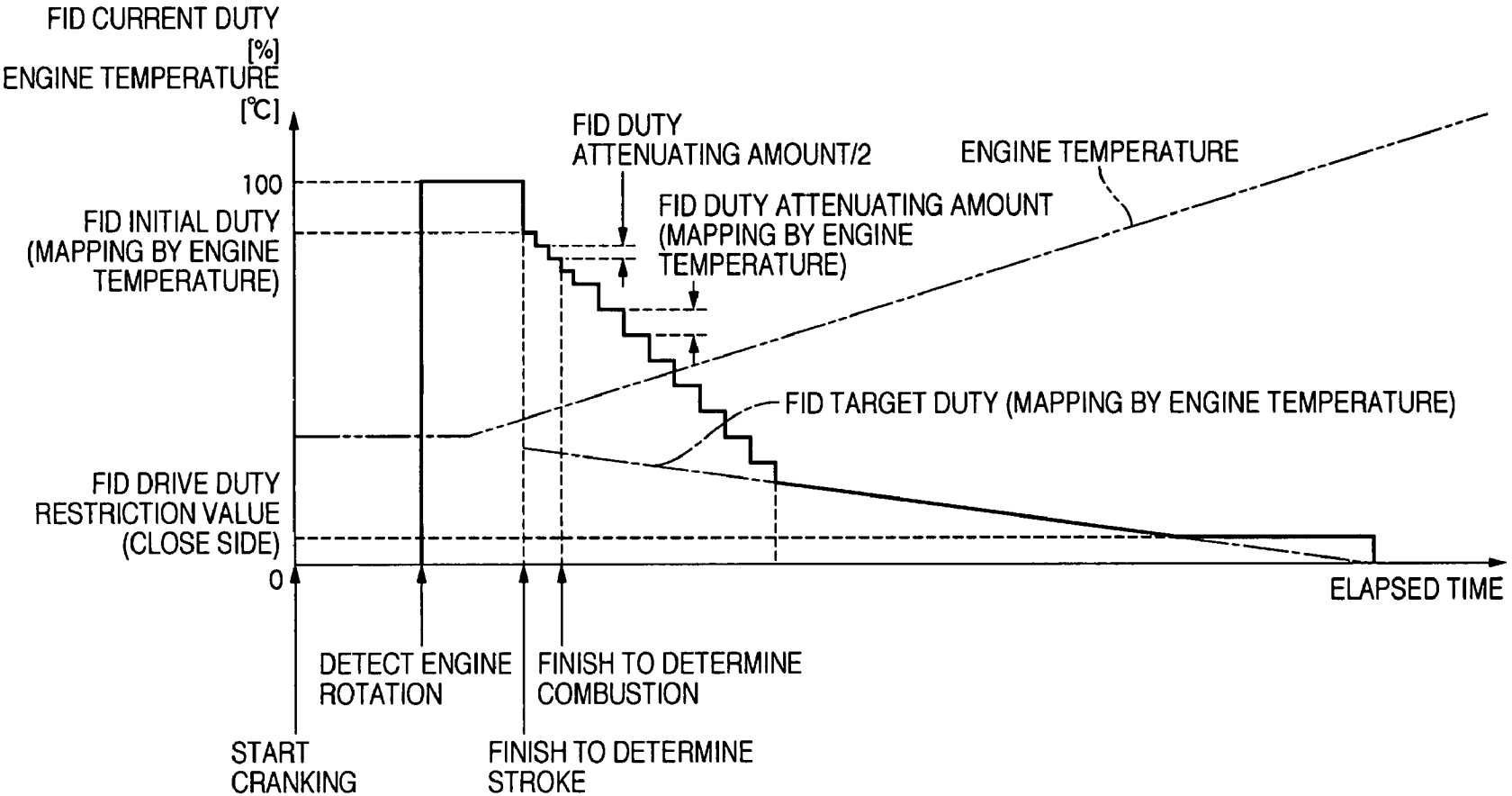
FIG. 13 is a timing chart of a control in an idle rotational speed controller of an internal combustion engine.

According to the timing chart of FIG. 13, cranking is started and the engine rotation is detected. When the cranking is started, the control valve 13 is closed and is opened at the upper dead center and is continued to open until finishing to determine combustion, and the ratio (duty) of the time period of opening the control valve 13 in the predetermined time period is set to 100.

When combustion is finished to be determined, the control valve 13 is duty controlled by FID initial duty searched by mapping of the engine temperature. The control valve 13 is duty controlled while attenuating the duty by each FID duty attenuating amount/2 by mapping of the engine temperature and is duty controlled by the FID duty attenuating amount searched by mapping by the engine temperature.

When the attenuated duty becomes smaller than FID target duty, the control valve 13 is duty controlled by the FID target duty by the engine temperature mapping, the control valve 13 is controlled by the constant duty control from the FID drive duty control value (close side), and when the duty in calculation becomes "0", duty control of the control value 13 is stopped.

The first embodiment to the fourth embodiment are applicable to the internal combustion control apparatus or the internal combustion respectively by themselves or applicable by combinations of any of them.

INDUSTRIAL APPLICABILITY

The invention is applicable to an idle rotational speed controller and an internal combustion control apparatus of an internal combustion as well as an internal combustion engine including an intake path for sucking air to be supplied to a combustion chamber of the internal combustion engine, and an auxiliary intake path communicating with a downstream side of a throttle valve arranged at the intake path for controlling an intake amount, and a control valve arranged at the auxiliary intake path for controlling an idling intake amount.

The invention claimed is:

1. An idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller comprising:

an intake pressure detecting unit for detecting an intake pressure of the intake path;

a fuel supplying unit for controlling a supply amount of a fuel supplied to the combustion chamber based on at least the intake pressure; and a controlling unit for synchronizing a drive reference position for driving to open or close the control valve with a timing of detecting the intake pressure by the intake pressure detecting unit.

2. The idle rotational speed controller of an internal combustion engine according to claim 1, wherein the controlling unit controls a state of closing the control valve by setting a timing of driving to close the control valve as the drive reference position.

3. The idle rotational speed controller of an internal combustion engine according to claim 1, wherein the controlling unit increases the supply amount of the fuel when a pressure difference between the intake pressure before one cycle or more and a current one is equal to or larger than a threshold in accordance with a state of opening or closing the control valve.

4. The idle rotational speed controller of an internal combustion engine according to claim 3, wherein the threshold is set by a two-dimensional table constituting an axis thereof by an engine rotational speed.

5. The idle rotational speed controller of an internal combustion engine according to claim 3, wherein the controlling unit increases the supply amount of the fuel by asynchronous injection.

6. An idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller comprising:

an intake pressure detecting unit for detecting an intake pressure of the intake path;

a stroke determining unit for determining a stroke of the internal combustion engine based on at least the intake pressure; and a controlling unit for synchronizing a drive reference position for driving to open or close the control valve with a timing of detecting the intake pressure by the intake pressure detecting unit.

7. The idle rotational speed controller of an internal combustion engine according to claim 6, wherein the controlling unit controls a state of closing the control valve by setting a timing of driving to close the control valve as the drive reference position.

8. An idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller comprising:

an intake pressure detecting unit for detecting an intake pressure of the intake path;

a stroke determining unit for determining a stroke of the internal combustion engine based on at least the intake pressure; and a controlling unit for controlling the control valve by synchronizing a drive reference position for driving to open or close the control valve with a timing of detecting the intake pressure by the intake pressure detecting unit, and changing the drive reference position with respect to a crank rotation of the internal combustion engine after finishing to determine the stroke by the stroke determining unit from that of before finishing to determine the stroke.

9. The idle rotational speed controller of an internal combustion engine according to claim 8, wherein the controlling unit controls to bring about the drive reference position once for each rotation of a crank before finishing to determine the stroke by the stroke determining unit and bring about the drive reference position once for each two rotations of the crank after finishing to determine the stroke.

10. An idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller comprising:

an intake pressure detecting unit for detecting an intake pressure of the intake path;

a stroke determining unit for determining a stroke of the internal combustion engine based on at least the intake pressure; and a controlling unit for controlling the control valve by synchronizing a drive reference position for driving to open or close the control valve with a timing of detecting the intake pressure by the intake pressure detecting unit, and preventing the control valve from being driven to open or close before finishing to determine the stroke by the stroke determining unit.

11. An idle rotational speed controller of an internal combustion engine including an intake path for sucking air to be supplied to a combustion chamber of the internal combustion engine, a throttle valve arranged at the intake path for controlling an intake amount, an auxiliary intake path for communicating the intake path on an upstream side of the throttle valve and the intake path on a downstream side of the throttle valve, and an opening/closing type control valve arranged at the auxiliary intake path for controlling an idling intake amount, the idle rotational speed controller comprising:

an intake pressure detecting unit for detecting an intake pressure of the intake path;

a fuel supplying unit for controlling a supply amount of a fuel supplied to the combustion chamber based on at least the intake pressure; and a controlling unit for synchronizing a drive reference position for driving to open or close the control valve with a timing of detecting the intake pressure by the intake pressure detecting unit.

12. The idle rotational speed controller of an internal combustion engine according to claim 11, wherein the controlling unit controls a state of closing the control valve by setting a timing of driving to close the control valve as the drive reference position.

13. An internal combustion engine including the idle rotational speed controller of an internal combustion engine according to any one of claims 1 to 12.

14. A controller of an internal combustion engine comprising an intake path for sucking air to be supplied to a combustion chamber of the internal combustion engine, a fuel supplying unit for supplying a fuel to the combustion chamber, a throttle valve arranged at the intake path for controlling an intake amount, and intake pressure detecting unit for detecting an intake pressure of the intake path;

wherein the fuel supplying unit increases a supply amount of the fuel when a pressure difference of the intake pressure before one cycle or more and a current one is equal to or larger than a threshold in accordance with an engine rotational speed of the internal combustion engine, wherein the threshold is set by a two-dimensional table constituting an axis thereof by the engine rotational speed, and the threshold is changed depending on the engine rotational speed.

15. The internal combustion engine control apparatus according to claim 14, wherein the controlling unit increases the supply amount of the fuel by asynchronous injection.

16. An internal combustion engine including the controller of an internal combustion engine according to any one of claims 14 and 15.

* * * * *